US010408408B2

(12) United States Patent
Chen et al.

(10) Patent No.: US 10,408,408 B2
(45) Date of Patent: Sep. 10, 2019

(54) AUTOMOTIVE HEADLAMP WITH S-POLARIZER FILTER TO REDUCE GLARE

(71) Applicant: Ford Global Technologies, LLC, Dearborn, MI (US)

(72) Inventors: Linsheng Chen, Rochester Hills, MI (US); Steven J. Antilla, Brighton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 107 days.

(21) Appl. No.: 15/685,093

(22) Filed: Aug. 24, 2017

(65) Prior Publication Data

US 2019/0063715 A1 Feb. 28, 2019

(51) Int. Cl.

| | |
|---|---|
| ***F21S 41/20*** | (2018.01) |
| ***F21V 9/14*** | (2006.01) |
| ***F21V 5/04*** | (2006.01) |
| ***F21V 7/08*** | (2006.01) |
| ***F21V 13/14*** | (2006.01) |
| ***F21S 41/141*** | (2018.01) |
| ***F21S 41/32*** | (2018.01) |
| ***F21S 41/135*** | (2018.01) |
| ***F21S 41/143*** | (2018.01) |
| ***F21S 41/255*** | (2018.01) |

(Continued)

(52) U.S. Cl.

CPC ..... *F21S 41/285* (2018.01); *F21S 41/135* (2018.01); *F21S 41/141* (2018.01); *F21S 41/143* (2018.01); *F21S 41/255* (2018.01); *F21S 41/26* (2018.01); *F21S 41/32* (2018.01); *F21S 41/365* (2018.01); *F21V 5/043* (2013.01); *F21V 7/08* (2013.01); *F21V 9/14* (2013.01); *F21V 13/14* (2013.01); *F21Y 2115/10* (2016.08)

(58) Field of Classification Search

CPC ..... F21S 41/285; F21S 41/141; F21S 41/32; F21V 5/043; F21V 7/08; F21V 9/14; F21V 13/14

USPC ..... 362/19, 507, 509

See application file for complete search history.

(56) References Cited

U.S. PATENT DOCUMENTS 3,808,422 A * 4/1974 Handtmann ..... G02B 27/283 362/19

6,007,221 A 12/1999 Taniuchi et al.

(Continued)

FOREIGN PATENT DOCUMENTS

DE 3222414 A1 12/1983

DE 19642467 A1 4/1998

(Continued)

*Primary Examiner* — Paultep Savusdiphol

(74) *Attorney, Agent, or Firm* — Vichit Chea; Price Heneveld LLP

(57) ABSTRACT

A headlamp for a vehicle comprises: a light source emitting light forming a beam pattern, the light comprising light waves having an electric field vector oscillating in all directions perpendicular to a path of travel of the light wave, and the beam pattern comprising a foreground portion relative to a horizontal axis and a non-foreground portion; and one or more filters dedicated to the foreground portion of the beam pattern that does not transmit light waves having an electric field vector oscillating in a direction parallel to the horizontal axis. The light source can be one or more light emitting diodes. The filter can be an absorptive polarizer. The absorptive polarizer can be a polarizing sheet.

20 Claims, 16 Drawing Sheets

(51) Int. Cl.

| | |
|---|---|
| ***F21S 41/26*** | (2018.01) |
| ***F21S 41/365*** | (2018.01) |
| *F21Y 115/10* | (2016.01) |

(56) References Cited

U.S. PATENT DOCUMENTS

| | | | | |
|---|---|---|---|---|
| 6,646,801 | B1 | 11/2003 | Sley | |
| 7,134,771 | B2 * | 11/2006 | Stout | F21S 41/686 362/465 |
| 2003/0189839 | A1 * | 10/2003 | Shikano | F21S 41/135 362/509 |
| 2005/0180144 | A1 * | 8/2005 | Stout | F21S 41/686 362/307 |
| 2013/0155645 | A1 * | 6/2013 | Marius | G02B 27/281 362/19 |
| 2014/0176781 | A1 * | 6/2014 | Zhang | H01L 27/14618 348/342 |

FOREIGN PATENT DOCUMENTS

| | | | |
|---|---|---|---|
| DE | 102013005083 | A1 | 9/2014 |
| KR | 20010077691 | A | 8/2001 |

* cited by examiner

AUTOMOTIVE HEADLAMP WITH S-POLARIZER FILTER TO REDUCE GLARE

FIELD OF THE INVENTION

The present invention generally relates to a headlamp for a vehicle that emits light to illuminate a roadway.

BACKGROUND OF THE INVENTION

Many vehicles include headlamps to illuminate the exterior of the vehicle. Sometimes the headlamps can cause glare that is perceived by an operator of another vehicle. Glare can increase during a wet roadway condition.

SUMMARY OF THE INVENTION

According to one aspect of the present invention, a headlamp for a vehicle comprises: a light source emitting light forming a beam pattern, the light comprising light waves having an electric field vector oscillating in all directions perpendicular to a path of travel of the light wave, and the beam pattern comprising a foreground portion relative to a horizontal axis and a non-foreground portion; and one or more filters dedicated to the foreground portion of the beam pattern that does not transmit light waves having an electric field vector oscillating in a direction parallel to the horizontal axis.

Embodiments of the first aspect of the invention can include any one or a combination of the following features:

- the light source is one or more light emitting diodes;
- the filter is an absorptive polarizer;
- the absorptive polarizer is a polarizing sheet;
- the headlamp further comprises: a first reflector disposed above the light source; a second reflector disposed below the light source; a rectangular lens forward of the light source; wherein, the light source includes more than one light emitting diode disposed horizontally parallel to the horizontal axis; wherein, the one or more filters include a first filter and a second filter above the more than one light emitting diodes; and wherein, the one or more filters include a third filter and a fourth filter below the more than one light emitting diodes;
- the headlamp further comprises: a rectangular lens; and a torus lens disposed above the rectangular lens; wherein, the light source includes more than one light emitting diode disposed on a horizontal plane and rearward of the rectangular lens; wherein, the light source further includes a light emitting diode rearward of the torus lens and above the rectangular lens; and wherein, at least one of the one or more filters is disposed adjacent the torus lens and between the torus lens and the light emitting diode rearward of the torus lens;
- the headlamp further comprises: an ellipsoid reflector above the light source; and an aspherical lens forward the light source and ellipsoid reflector; wherein, the at least one of the one or more filters is disposed between the ellipsoid reflector and the aspherical lens.

According to a second aspect of the present invention, a vehicle comprises: a headlamp comprising: a light source emitting light forming a beam pattern, the light comprising light waves having an electric field vector oscillating in all directions perpendicular to a path of travel of the light wave, and the beam pattern comprising a foreground portion relative to a horizontal axis and a non-foreground portion; and one or more filters dedicated to the foreground portion of the beam pattern that does not transmit light waves having an electric field vector oscillating in a direction parallel to the horizontal axis.

Embodiments of the second aspect of the invention can include any one or a combination of the following features:

- the light source is one or more light emitting diodes;
- the filter is an absorptive polarizer;
- the absorptive polarizer is a polarizing sheet;
- the headlamp further comprising: a first reflector disposed above the light source; a second reflector disposed below the light source; a rectangular lens forward of the light source; wherein, the light source includes more than one light emitting diode disposed horizontally parallel to the horizontal axis; wherein, the one or more filters include a first filter and a second filter above the more than one light emitting diodes; and wherein, the one or more filters include a third filter and a fourth filter below the more than one light emitting diodes;
- the headlamp further comprises: a rectangular lens; and a torus lens disposed above the rectangular lens; wherein, the light source includes more than one light emitting diode disposed horizontally parallel to the horizontal axis and rearward of the rectangular lens; wherein, the light source further includes a light emitting diode rearward of the torus lens and above the rectangular lens; and wherein, at least one of the one or more filters is disposed adjacent the torus lens and vertically between the torus lens and the light emitting diode rearward of the torus lens; and
- the headlamp further comprises: an ellipsoid reflector above the light source; and an aspherical lens forward the light source and ellipsoid reflector; wherein, the at least one of the one or more filters is disposed between the ellipsoid reflector and the aspherical lens.

According to a third aspect of the present invention, a method of reducing the amount glare-inducing light that a vehicle headlamp produces during wet roadway conditions comprises: presenting the headlamp comprising a light source emitting light forming a beam pattern, the light comprising light waves having an electric field vector oscillating in all directions perpendicular to a path of travel of the light wave, and the beam pattern comprising a foreground portion relative to a horizontal axis and a non-foreground portion; and removing, before the light leaves the vehicle, from the foreground portion, light waves having an electric field vector oscillating in a horizontal direction relative to the roadway.

Embodiments of the third aspect of the invention can include any one or a combination of the following features:

- removing light waves having an electric field vector oscillating in a horizontal direction relative to the roadway includes placing one or more filters dedicated to the foreground portion of the beam pattern that do not transmit light waves having an electric field vector oscillating in a direction parallel to the horizontal axis but do transmit light waves having an electric field vector oscillating in a direction perpendicular to the horizontal axis;
- the light source is one or more light emitting diodes;
- the filter is an absorptive polarizer;
- the absorptive polarizer is a polarizing sheet; and
- the method further comprises increasing the intensity of the light that the light source emits.

These and other aspects, objects, and features of the present invention will be understood and appreciated by those skilled in the art upon studying the following specification, claims, and appended drawings.

DETAILED DESCRIPTION OF THE PREFERRED EMBODIMENTS

For purposes of description herein, the terms "above," "below," "forward," "in front of," rearward," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
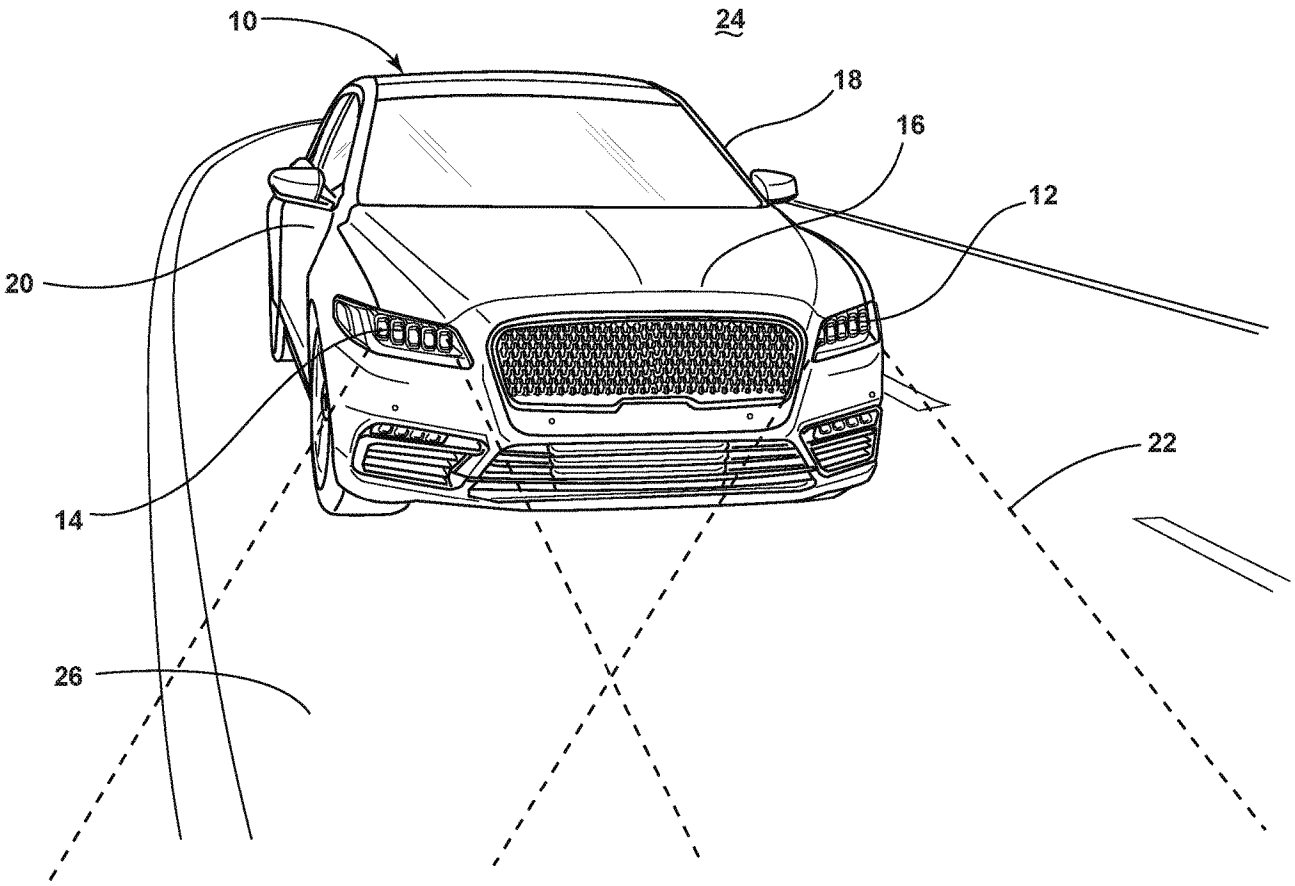
FIG. 1 is a perspective view of a vehicle with a first headlamp providing light to an exterior to illuminate a roadway.

Referring to FIG. 1, a vehicle 10 comprises a first headlamp 12 and a second headlamp 14 at or near the front 16. The first headlamp 12 is nearer an operator side 18 of the vehicle 10 than the second headlamp 14. The second headlamp 14 is nearer a passenger side 20 of the vehicle 10 than the first headlamp 12. The passenger side 20 is opposite the operator side 18. The first headlamp 12 and the second headlamp 14 provide light 22 that leaves the vehicle 10 and illuminates an exterior 24, such as a roadway 26. For purposes of this disclosure, the second headlamp 14 is identical to the first headlamp 12. Further, some vehicles may utilize only the first headlamp 12, such as a motorcycle. Thus, this disclosure will discuss generally only the first headlamp 12.

Figure 2:
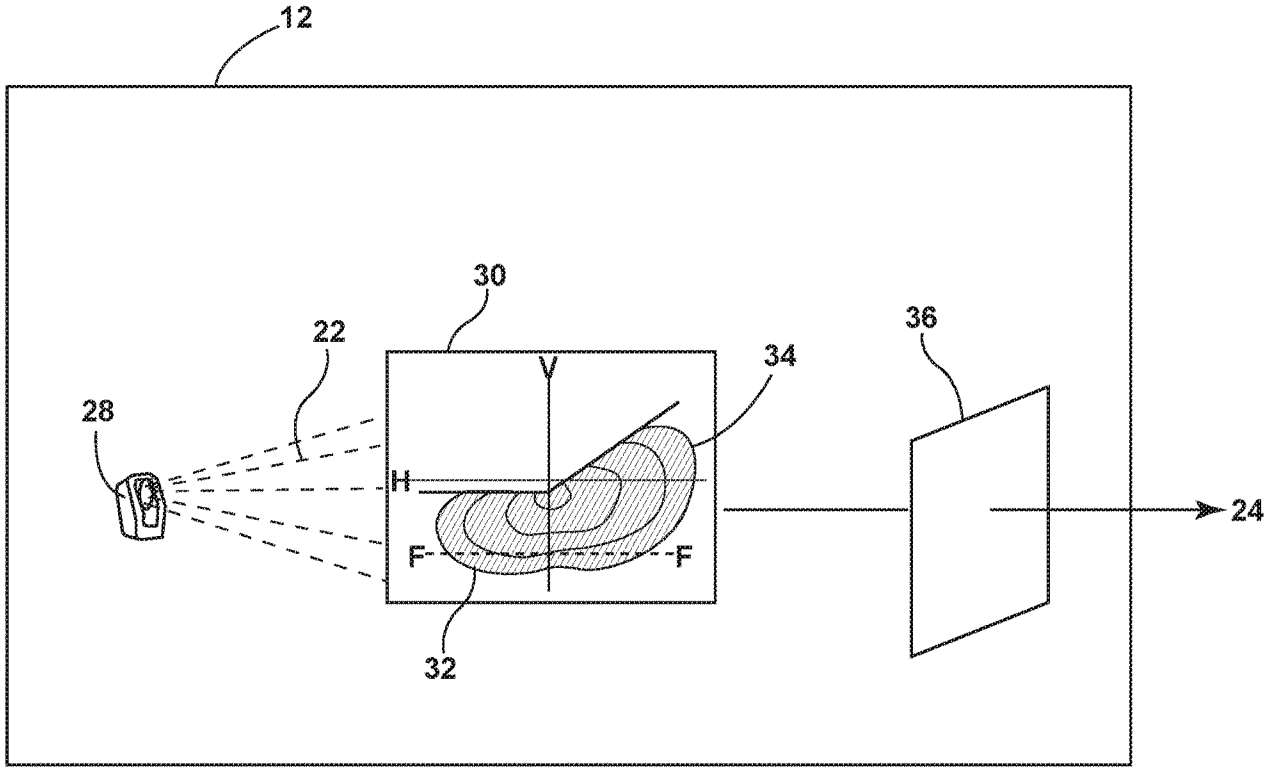
FIG. 2 is conceptual diagram of the first headlamp of FIG. 1, illustrating a light source emitting light with a particular beam pattern with a foreground portion that is altered by one or more filters before exiting the vehicle to the exterior.

Referring now to FIG. 2, the first headlamp 12 includes a light source 28. The light source 28 emits the light 22 that eventually exits the vehicle 10 and illuminates the exterior 24. The light source 28 in the embodiments disclosed herein comprises one or more light emitting diodes, but could be any source of light, including filament lamps and high intensity discharge lamps.

The light 22 comprises light waves (not shown) having electric field vectors oscillating in all directions perpendicular to a path of travel of the light wave. In other words, the light waves of the light 22 emitted by the light source 28 are not polarized. The light 22, if left un-manipulated by a filter (discussed below), forms a certain beam pattern 30. The beam pattern 30 comprises a foreground portion 32 and a non-foreground portion 34 relative to a horizontal axis H. The foreground portion 32 is disposed below a general boundary, denoted by line F-F, while the non-foreground portion 34 is disposed above the general boundary F-F. The foreground portion 32 represents the portion of the light 22 that would illuminate the roadway 26 directly in front of the front 16 of the vehicle 10. The foreground portion 32 of the light 22, if left un-manipulated, produces glare that an operator of an oncoming vehicle perceives, as discussed further below. The letter V represents a vertical axis for the beam pattern.

The first headlamp 12 further includes one or more filters 36. The one or more filters 36 are dedicated to the foreground portion 32 of the beam pattern 30. In other words, the portion of the light 22 that forms the foreground portion 32 of the beam pattern 30 generally encounters the one or more filters 36 (with some of the light 22 transmitting through the one or more filters 36), while the portion of the light 22 that forms the non-foreground portion 34 of the beam pattern 30 generally does not encounter the one or more filters 36. The one or more filters 36 do not transmit light waves having an electric field vector oscillating in a direction parallel to the horizontal axis H, but transmit all other light waves through the one or more filters 36. In other words, the one or more filters 36 removes S-polarized light waves from the light 22, transmitting the remaining light waves of the light 22, including P-polarized light waves, through the one or more filters 36 and eventually out to the exterior 24 of the vehicle 10. S-polarized light waves reflect most easily of all light waves off the roadway 26, especially when the roadway 26 is wet, causing glare to an oncoming vehicle, because the electric field vector of the S-polarized light waves oscillate parallel with the roadway 26, which is generally horizontal. The one or more filters 36 can be an absorptive polarizer, such as a Polaroid® (Polaroid Corporation) sheet or a polarizing sheet provided by any of a number of manufacturers. In general terms, the polarizing sheet absorbs incoming light waves of the light 22 of one plane of polarization, in this instance the horizontal plane, known as S-polarized light waves. Because the S-polarized light waves are absorbed before leaving the vehicle 10 to the exterior 24, there is less or no S-polarized light waves in the light 22 to reflect off of the roadway 26 and cause glare. The remaining light waves transmitted through the one or more filters 36 are more apt to be absorbed by the roadway 26 and thus not cause glare.

Referring now to FIGS. 3A-3E, an embodiment of the first headlamp 12, first headlamp 12A, includes as the light source 28A, more than one light emitting diode, specifically three light emitting diodes 38*a*, 38*b*, 38*c*. The three light emitting diodes 38*a*, 38*b*, 38*c* are disposed generally parallel to the horizontal axis H. Each of the three light emitting diodes 38*a*, 38*b*, 38*c* are partially surrounded by a PCS reflector 40*a*, 40*b*, 40*c*.

The first headlamp 12A further includes a first reflector 42. The first reflector 42 is disposed above the light source 28A. In other words, either the entirety or the vast majority of the first reflector 42 is positioned above the light source 28A, when in place on the vehicle 10. The first reflector 42 is above the horizontal plane that includes the horizontal axis H. The first reflector 42 is a half reflector.

The first headlamp 12A further includes a second reflector 44. The second reflector 44 is disposed below the light source 28A. In other words, either the entirety or the vast majority of the second reflector 44 is positioned below the light source 28A, when in place on the vehicle 10. The second reflector 44 is below the horizontal plane that includes the horizontal axis H. The second reflector 44 is also a half reflector. In this embodiment of the first headlamp 12A, the first reflector 42 and the second reflector 44 provide a wide light spread.

The first headlamp 12A further includes a rectangular lens 46 forward of the light source 28A. In other words, the rectangular lens 46 is positioned in front of the light source 28A, when in place on the vehicle 10. That is, the rectangular lens 46 is forward along the longitudinal axis L compared to the light source 28A. The rectangular lens 46 helps create a "hot spot," that is, a concentration of light intensity near the center of the light beam path.

The one or more filters 36 of the first headlamp 12A include a first filter $\mathbf{36}A_1$ and a second filter $\mathbf{36}A_2$ disposed above the horizontal plane including the horizontal axis H and thus the more than one light emitting diodes 38*a*-*c*. The first filter $\mathbf{36}A_1$ is disposed to one side 48 of the first reflector 42. The second filter $\mathbf{36}A_2$ is disposed to the other side 50 of the first reflector 42. The one or more filters 36 of the first headlamp 12A further include a third filter $\mathbf{36}A_3$ and a fourth filter $\mathbf{36}A_4$ disposed below the horizontal plane including the horizontal axis H and thus the more than one light emitting diodes 38*a*-*c*. The third filter $\mathbf{36}A_3$ is disposed to one side 52 of the second reflector 44. The fourth filter $\mathbf{36}A_4$ is disposed to the other side 54 of the second reflector 44.

Figure 3A:
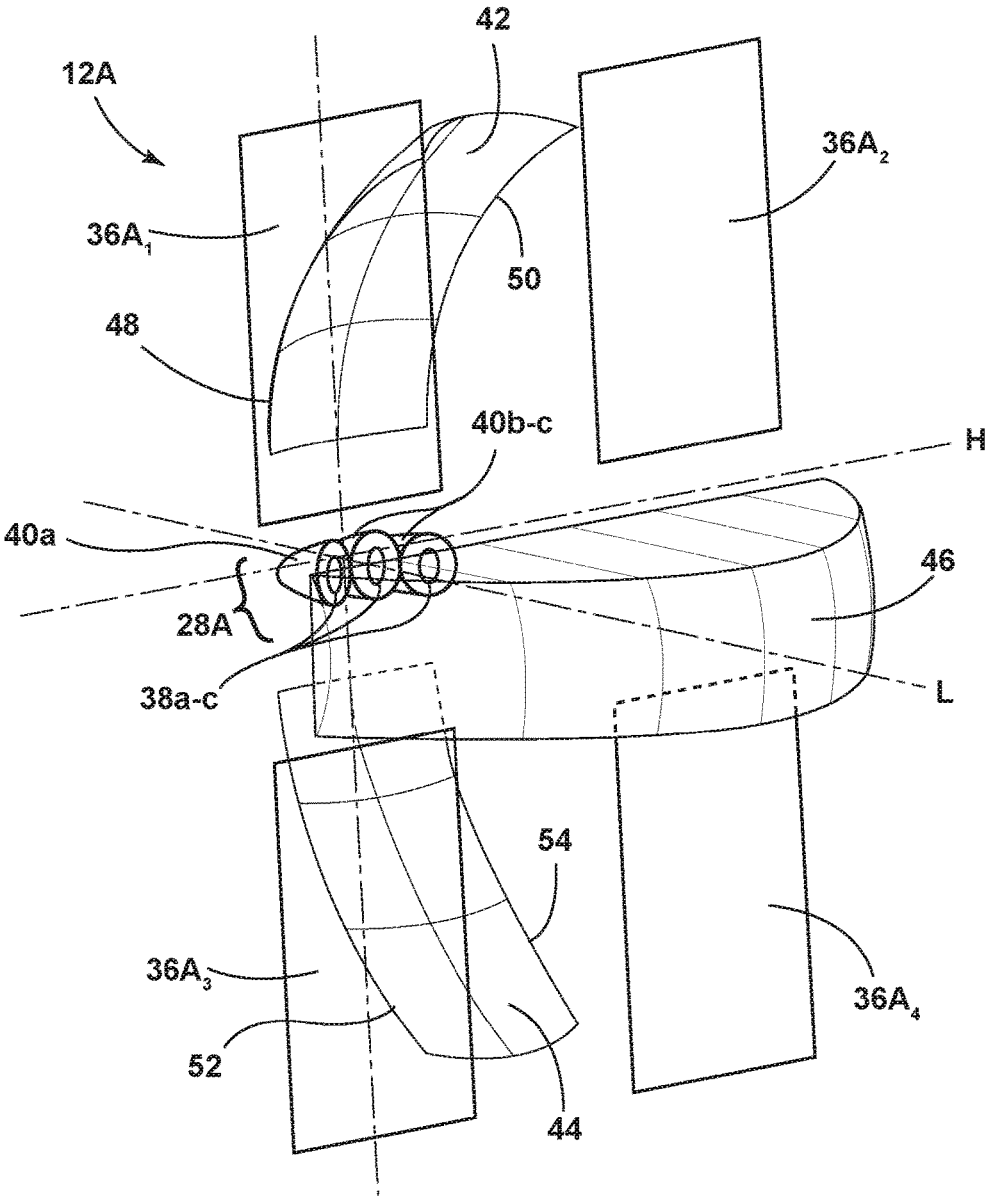
FIG. 3A is a perspective view of a first embodiment of the first headlamp of FIG. 1, illustrating two filters disposed above, and two filters disposed below, the light source.
Figure 3B:
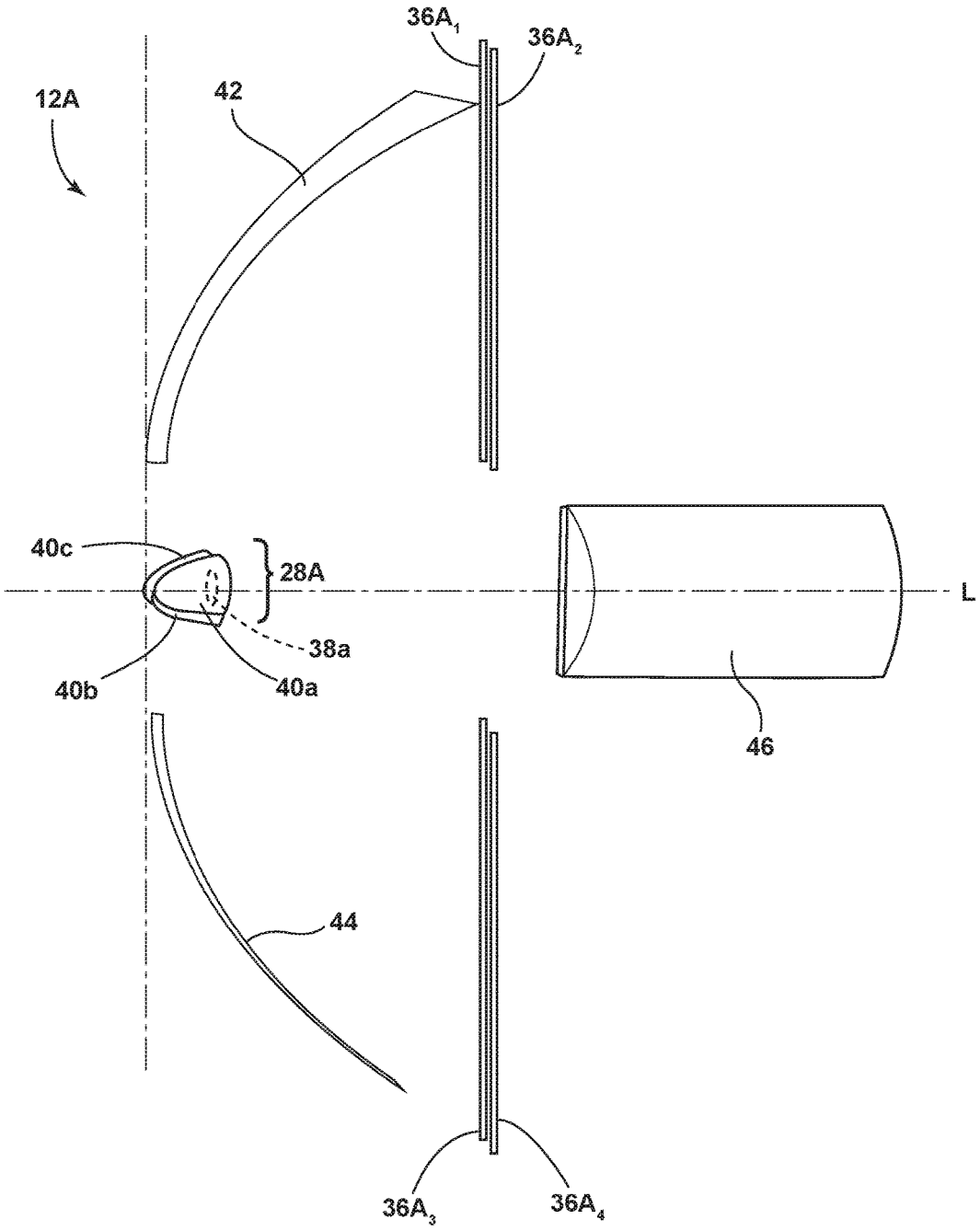
FIG. 3B is a side view of the first embodiment of the first headlamp of FIG. 1, illustrating a rectangular lens disposed forward the light source.
Figure 3C:
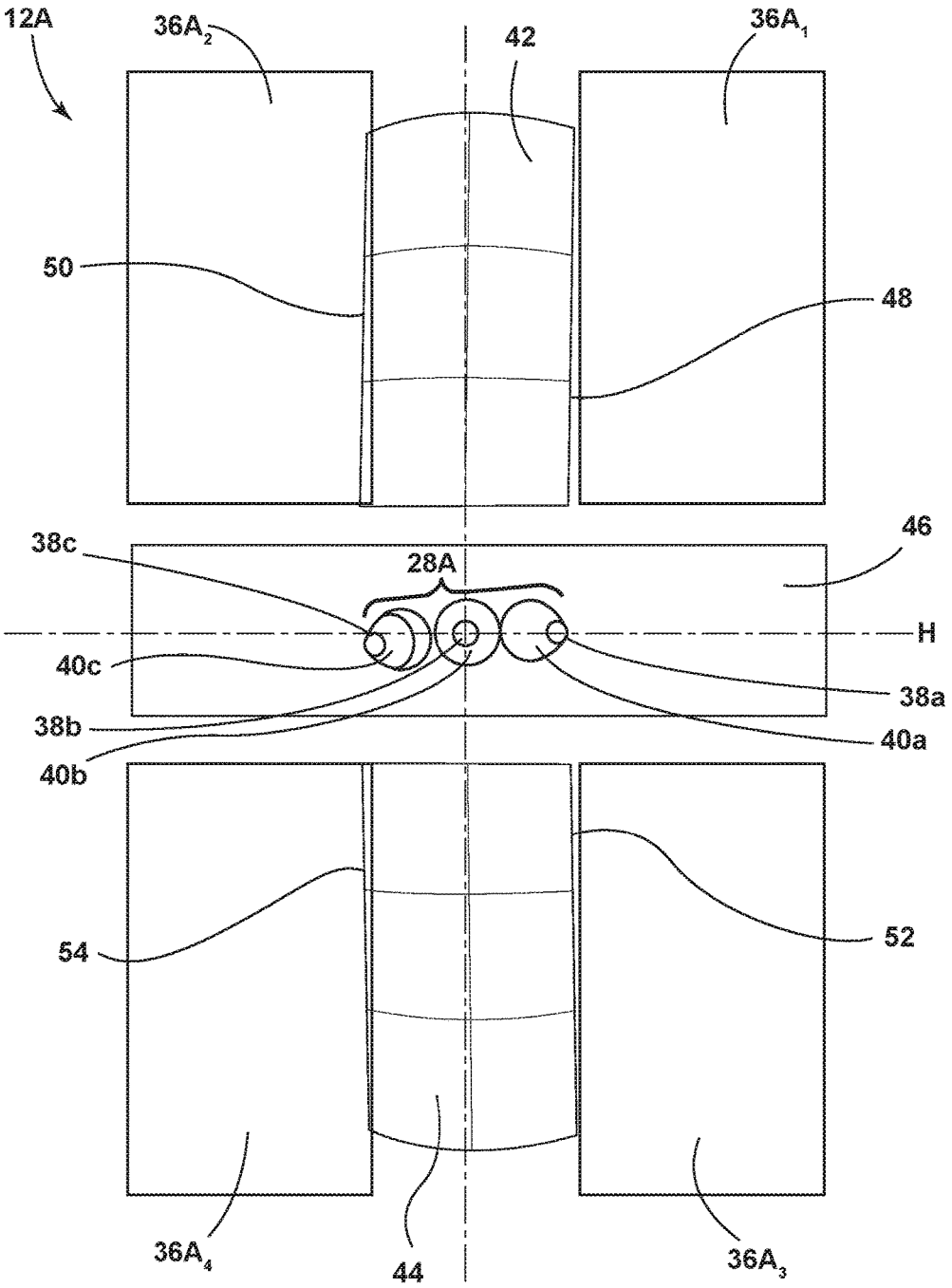
FIG. 3C is a rear view of the first embodiment of the first headlamp of FIG. 1, illustrating three LEDs each partially surrounded by a poly curve system ("PCS") reflector serving as the light source.
Figure 3D:
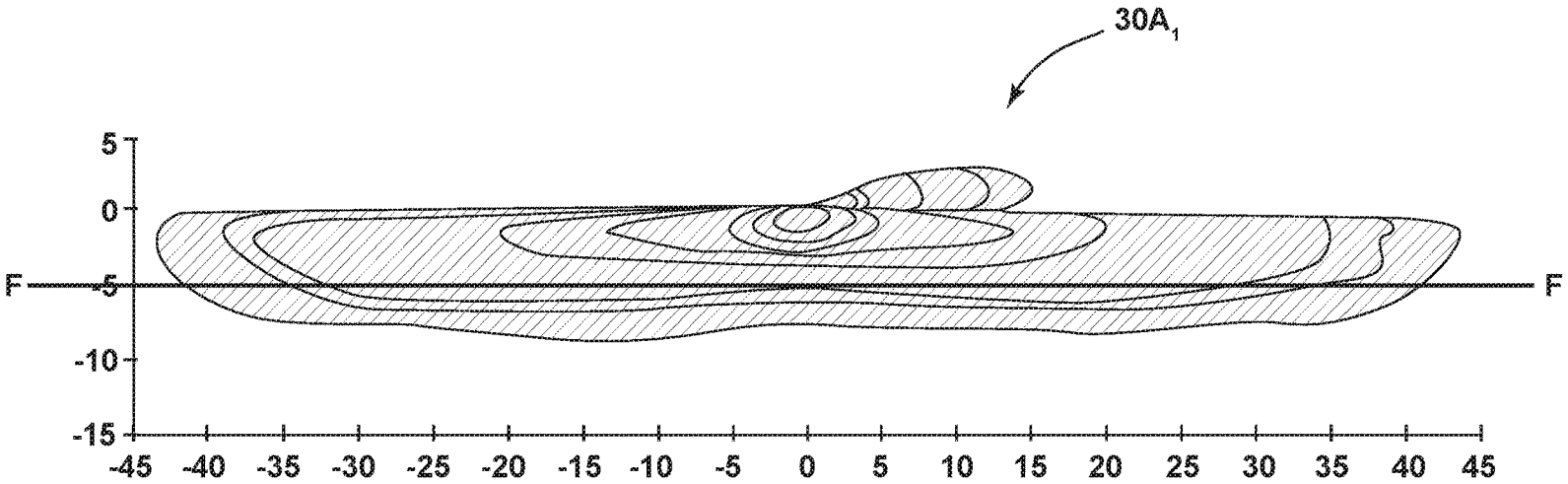
FIG. 3D illustrates the beam pattern of the light that the first embodiment of the first headlamp of FIG. 1 emits, if the filters were not present.

Without filters $\mathbf{36}A_1$-$\mathbf{36}A_4$, the light source 28A forms the beam pattern $\mathbf{30}A_1$ illustrated in FIG. 3D and the light 22 emitted from the light source 28A includes light waves having an electric field vector oscillating in all directions that are perpendicular to the path of travel of the light waves. In other words, the light emitted by the light source 28A has no particular overall polarization and includes S-polarized light. The foreground portion 32 of the beam pattern 30A is the beam pattern generally under line F-F, and the non-foreground portion 34 of the beam pattern 30A generally above the line F-F.

Figure 3E:
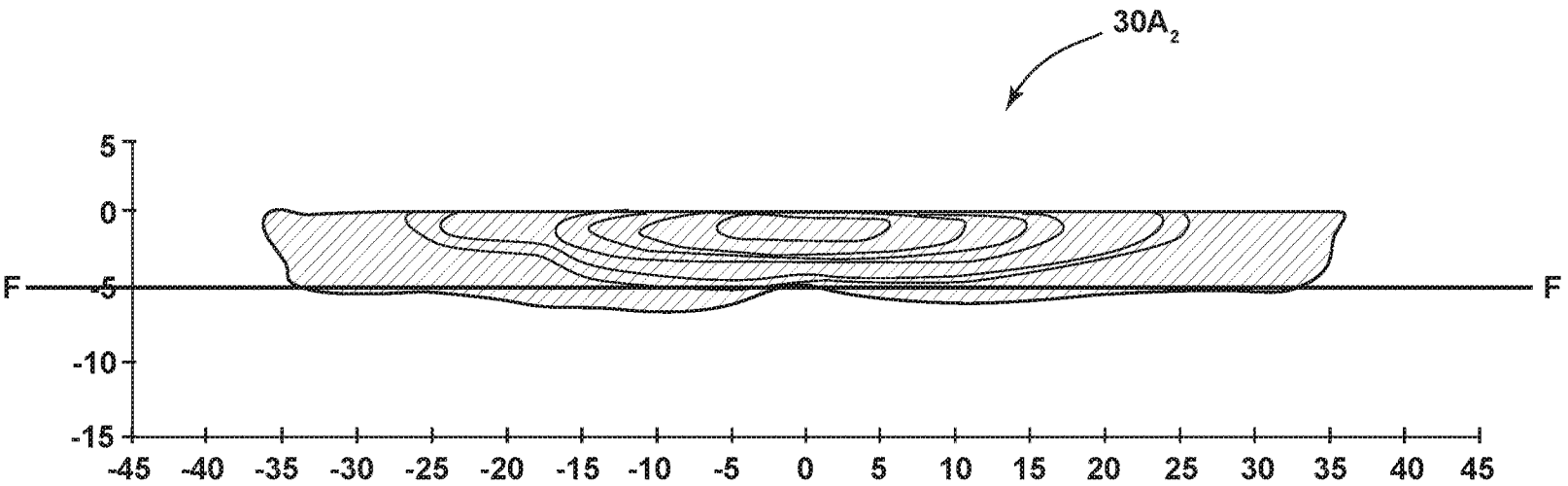
FIG. 3E illustrates the beam pattern of the light that the first embodiment of the first headlamp of FIG. 1 emits, if the filters are present.

With the filters $\mathbf{36}A_1$-$\mathbf{36}A_4$ present, the light source 28A forms the beam pattern $\mathbf{30}A_2$ illustrated in FIG. 3E. The filters $\mathbf{36}A_1$-$\mathbf{36}A_4$ have absorbed (and thus do not transmit) light waves of the light 22 emitted by the light source 28A that have an electric field vector oscillating in a direction parallel to the horizontal axis H. In other words, the filters $\mathbf{36}A_1$-$\mathbf{36}A_4$ have absorbed the S-polarized light waves predominately from the foreground portion 32 of the beam pattern $\mathbf{30}A_1$ (represented under line F-F) and thus those light waves are not present in beam pattern $\mathbf{30}A_2$. Because the filters $\mathbf{36}A_1$-$\mathbf{36}A_4$ have absorbed a portion of the light 22 emitted by the light source 28A, the intensity of the light 22 at the foreground portion 32 below F-F (FIG. 3E) is less than if the filters $\mathbf{36}A_1$-$\mathbf{36}A_4$ were not utilized (as illustrated in FIG. 3D). To overcome the decreased light intensity, the overall power of the light source 28A can be increased to compensate.

Referring now to FIGS. 4A-4E, another embodiment of the first headlamp 12, first headlamp 12B, is disclosed. The first headlamp 12B further includes a light source 28B. The first headlamp 12 includes a rectangular lens 56. The rectangular lens 56 is forward along the longitudinal axis L from the light source 28B and disposed on the same horizontal plane including the horizontal axis H. The rectangular lens 56 creates a "hot spot" zone of increased light intensity. The first headlamp 12B further includes a torus lens 58. The torus lens 58 is disposed above the rectangular lens 56. The torus lens 58 creates a zone of wide spread light. The light source 28B includes a PCS reflector 60*a* partially surrounding a light emitting diode 62*a*. The light emitting diode 62*a* is rearward (closer to the vertical axis V) of the torus lens 58 and above (vertically higher than) rectangular lens 56. That is, the light emitting diode 62*a* is disposed on a horizontal plane higher along the vertical axis V than a horizontal plane occupied by the rectangular lens 56. The light source 28B further includes three additional light emitting diodes 62*b*, 62*c*, 62*d*, disposed on the same horizontal plane as, and rearward of, the rectangular lens 56. Each of the three light emitting diodes 62*b*, 62*c*, 62*d* is partially surrounded by a PCS reflector 60*b*, 60*c*, 60*d*, respectively. The first headlamp 12B further includes a filter 36B. The filter 36B is disposed adjacent the torus lens 58 and between the torus lens 58 and the light emitting diode 62*a*, rearward of the torus lens 58. The first headlamp 12B can further include a block 64 disposed between the three light emitting diodes 62*b*-62*d* and the rectangular lens 56 to partially prevent light 22 emitted by the light source 28B from leaving the first headlamp 12B and illuminating a certain portion of the exterior 24.

Figure 4A:
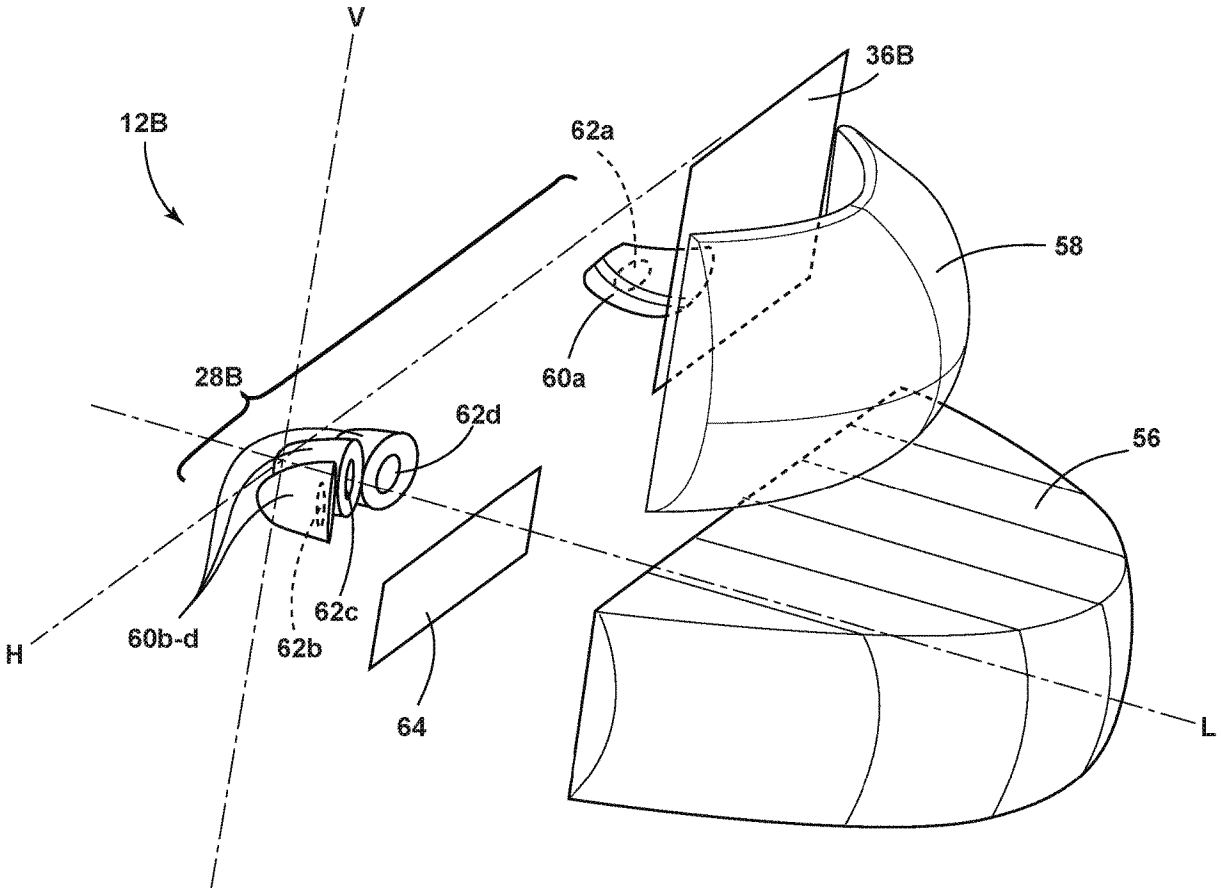
FIG. 4A is a perspective view of a second embodiment of the first headlamp of FIG. 1, illustrating three LEDs each partially surrounded by a PCS reflector disposed near the horizontal axis and a fourth LED partially surrounded by a PCS reflector disposed above and forward the three LEDs, which collectively serve as the light source.
Figure 4B:
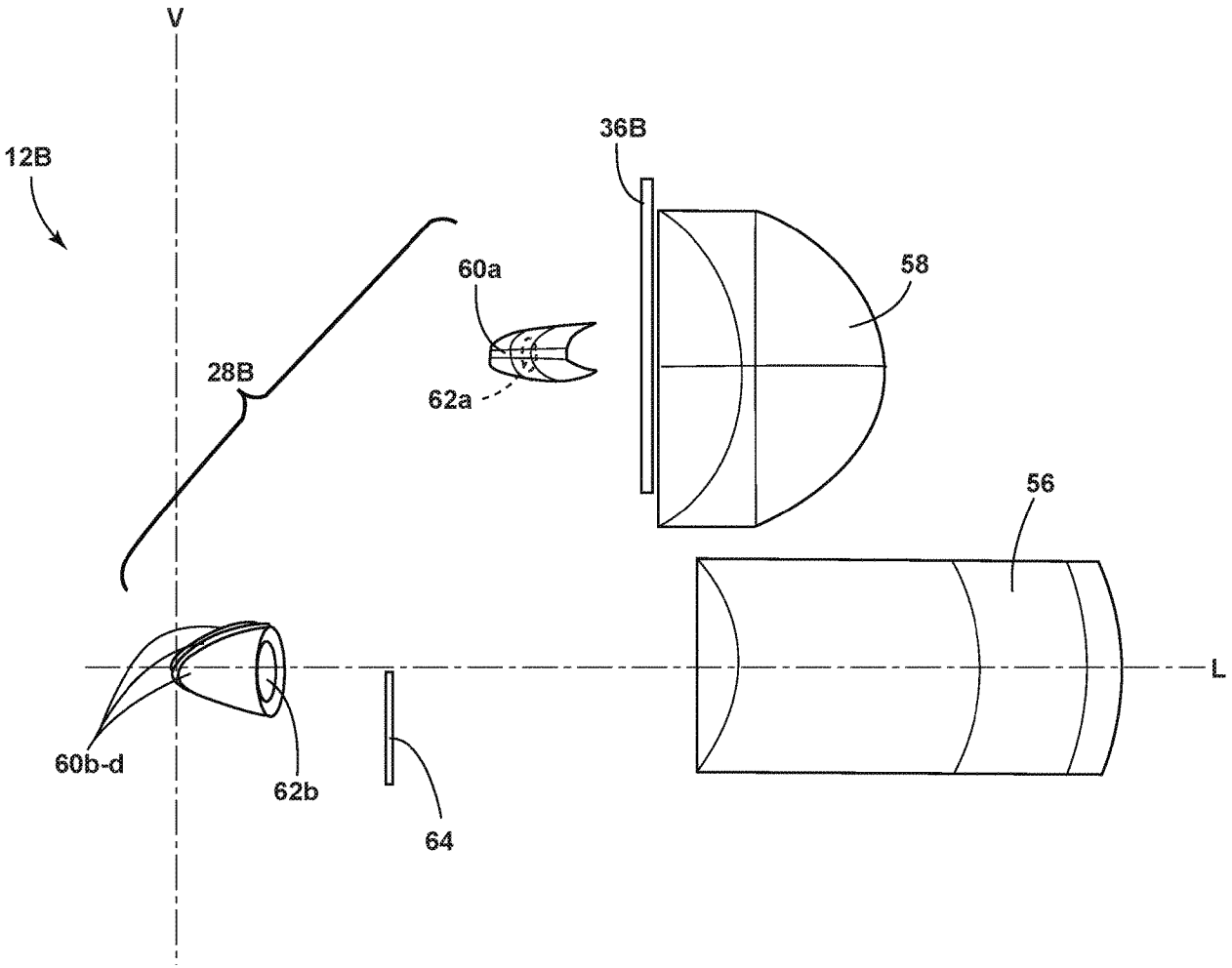
FIG. 4B is a side view of the second embodiment of the first headlamp of FIG. 1, illustrating a filter disposed forward the fourth LED and rearward of a torus lens.
Figure 4C:
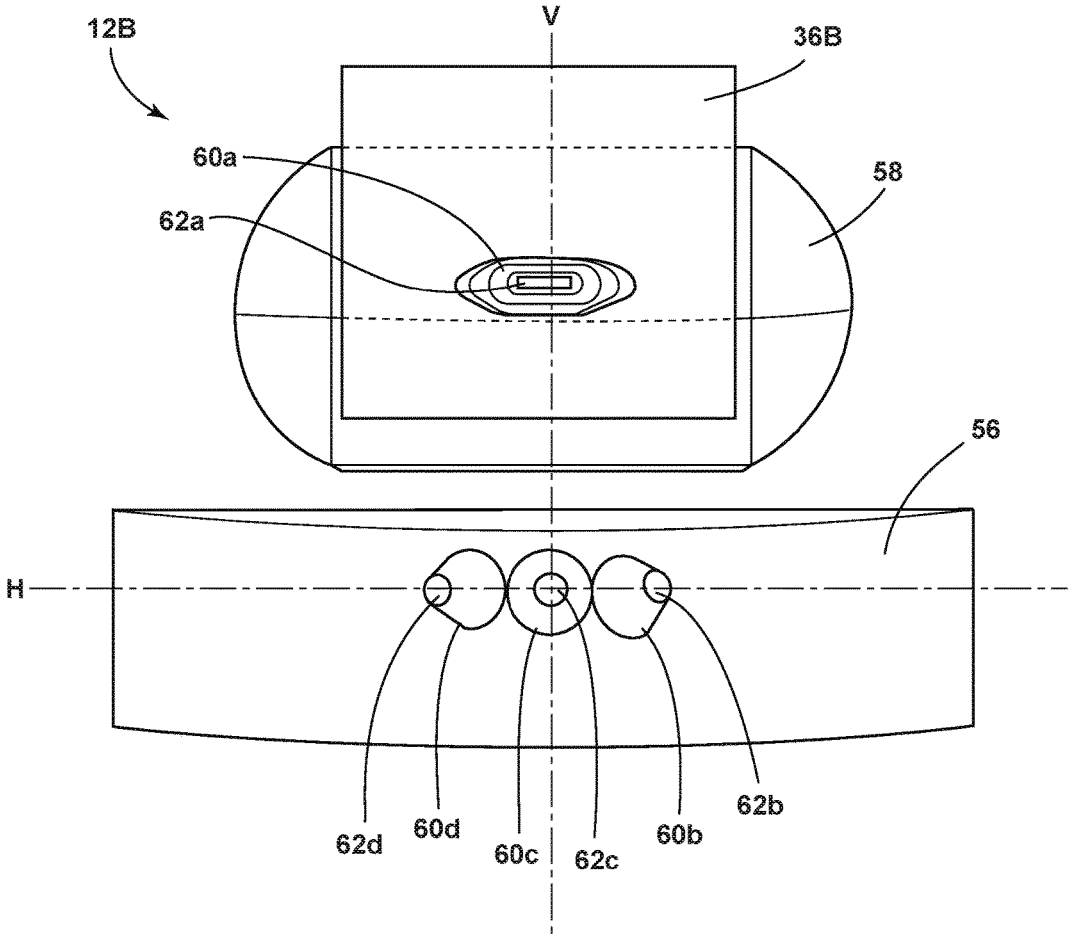
FIG. 4C is a rear view of the second embodiment of the first headlamp of FIG. 1, illustrating a rectangular lens forward the three LEDS along the horizontal axis.
Figure 4D:
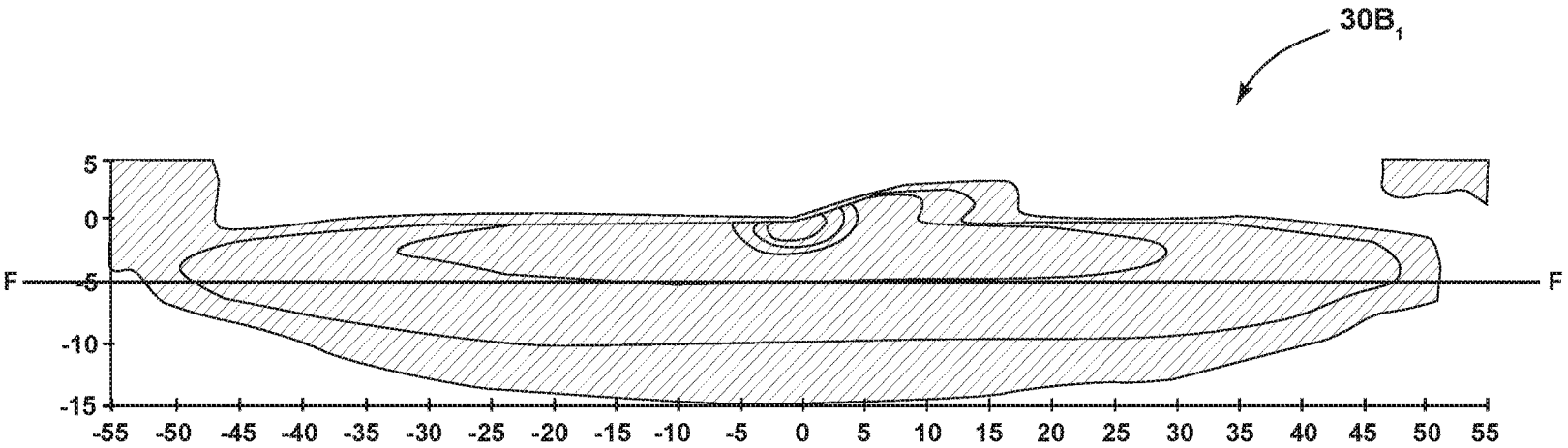
FIG. 4D illustrates the beam pattern of the light that the second embodiment of the first headlamp of FIG. 1 emits, if the filter was not present.

Without the filter 36B, the light source 28B forms the beam pattern $\mathbf{30}B_1$ illustrated in FIG. 4D and the light 22 emitted from the light source 28B includes light waves having an electric field vector oscillating in all directions that are perpendicular to the path of travel of the light waves. In other words, the light emitted by the light source 28B has no particular overall polarization and includes S-polarized light. The foreground portion 32 of the beam pattern $\mathbf{30}B_1$ is the beam pattern generally under line F-F, and the non-foreground portion 34 of the beam pattern $\mathbf{30}B_1$ generally above the line F-F.

Figure 4E:
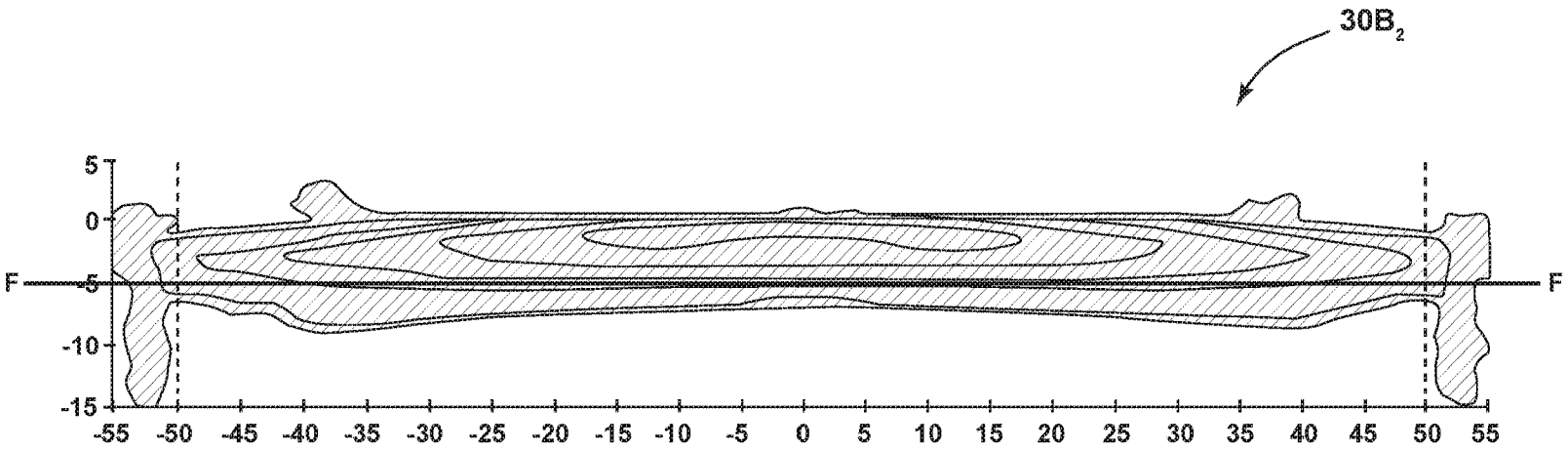
FIG. 4E illustrates the beam pattern of the light that the second embodiment of the first headlamp of FIG. 1 emits, if the filter is present.

With the filter 36B, the light source 28B forms the beam pattern $\mathbf{30}B_2$ illustrated in FIG. 4E. The filter 36B has absorbed (and thus does not transmit) light waves of the light 22 emitted by the light source 28B that have an electric field vector oscillating in a direction parallel to the horizontal axis H. In other words, the filter 36B has absorbed the S-polarized light waves predominately from the foreground portion 32 of the beam pattern 30$B_1$ (represented under line F-F) and thus those light waves are not present in beam pattern 30$B_2$. Because filter 36B has absorbed a portion of the light 22 emitted by the light source 28B, the intensity of the light 22 at the foreground portion 32 below F-F (FIG. 4E) is less than if the filter 36B was not utilized (FIG. 4D). To overcome the decreased intensity of the light 22, the overall power of the light source 28B can be increased to compensate.

Figure 5A:
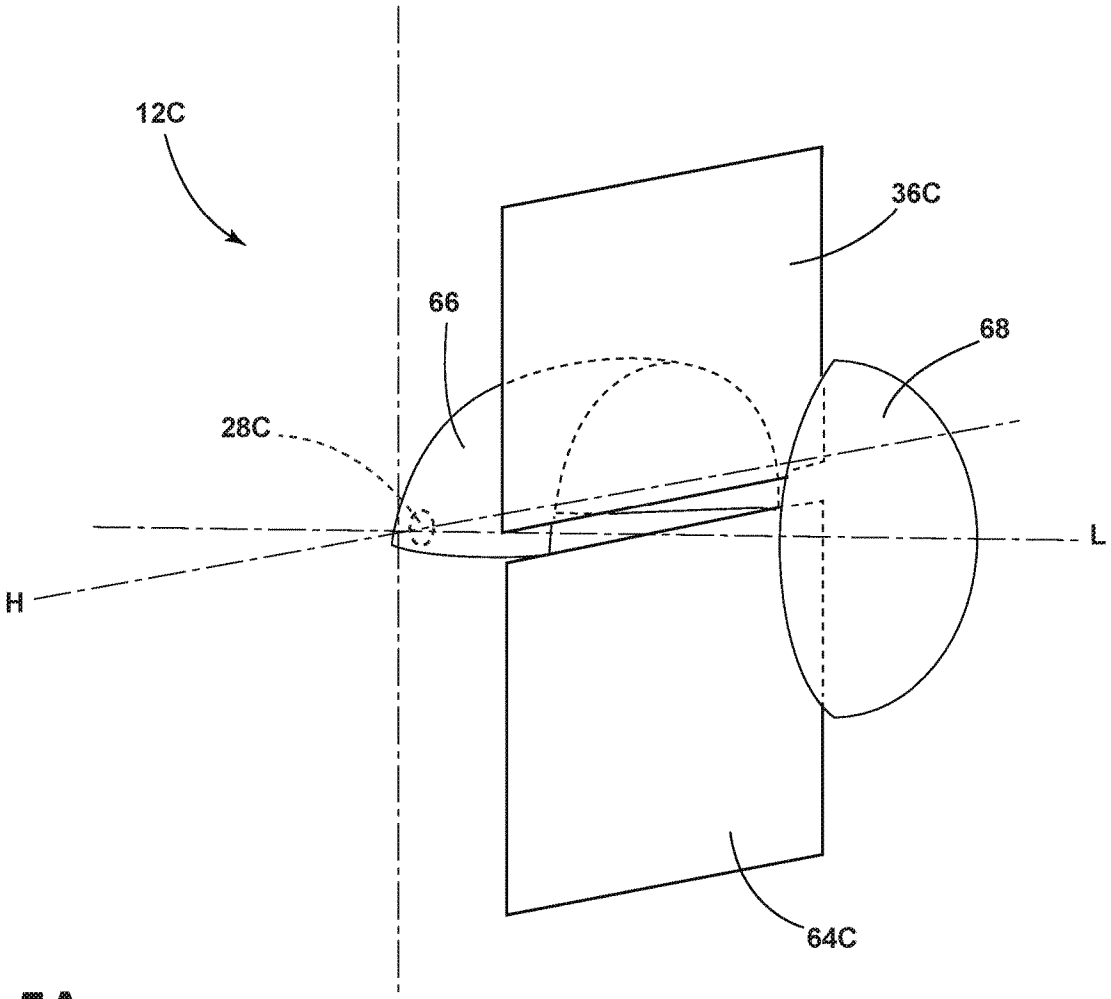
FIG. 5A is a perspective view of a third embodiment of the first headlamp of FIG. 1, illustrating a filter disposed above the neutral horizontal plane and between a ellipsoid reflector and an aspherical lens.
Figure 5B:
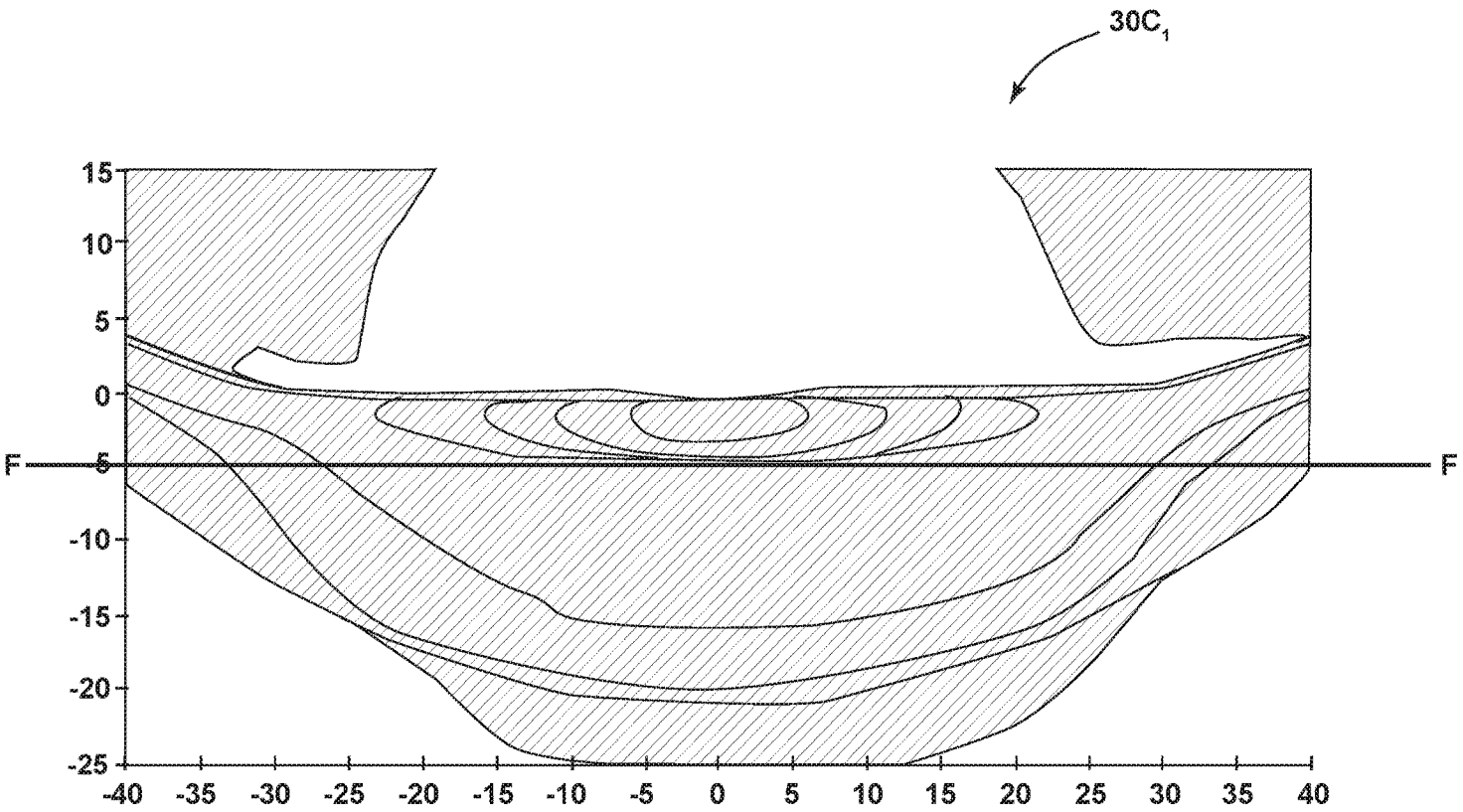
FIG. 5B illustrates the beam pattern of the light that the third embodiment of the first headlamp of FIG. 1 emits, if the filter was not present.
Figure 5C:
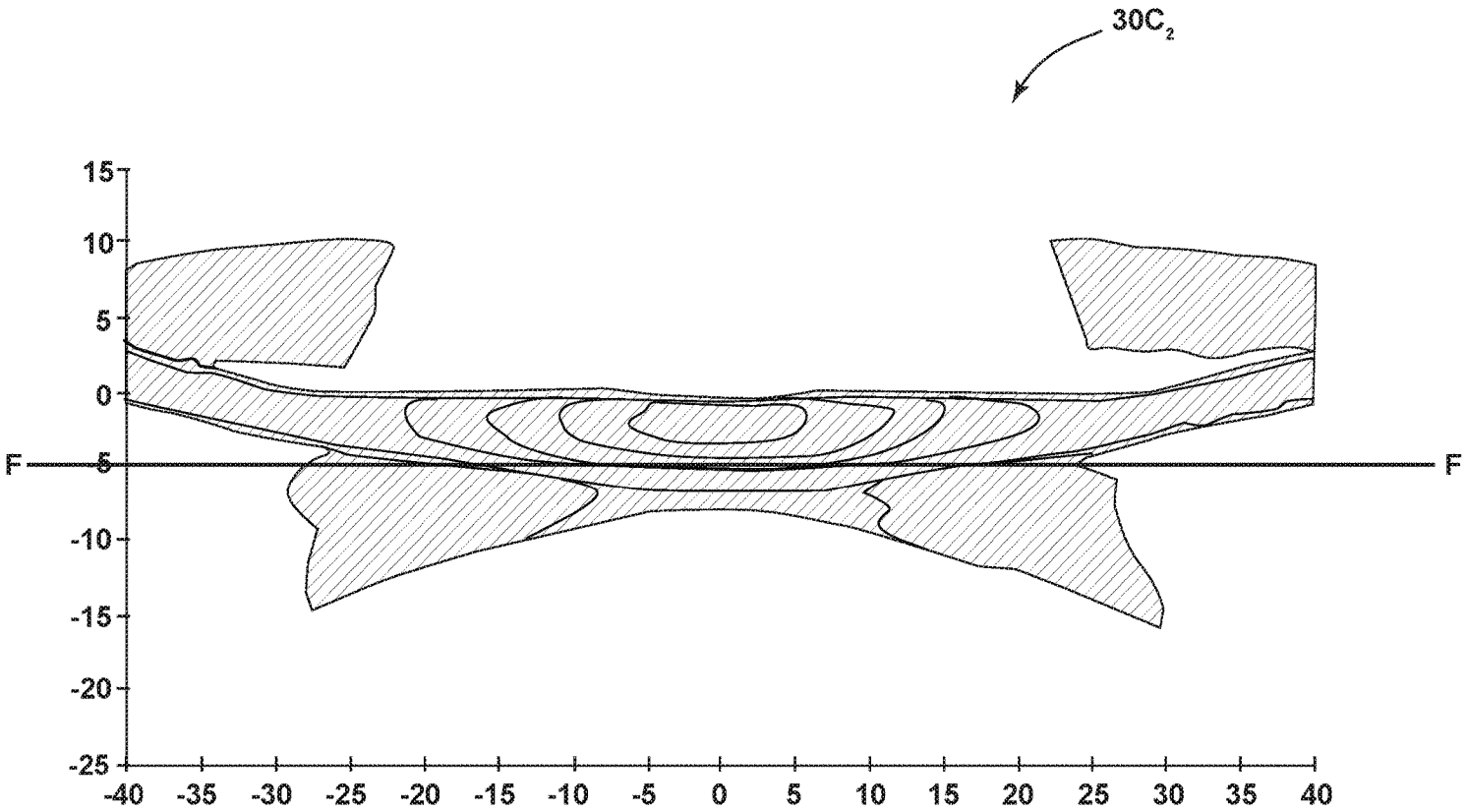
FIG. 5C illustrates the beam pattern of the light that the third embodiment of the first headlamp of FIG. 1 emits, if the filter is present.

Referring now to FIGS. 5A-5C, another embodiment of the first headlamp 12, first headlamp 12C, is disclosed. The first headlamp 12C includes an ellipsoid reflector 66 disposed above the light source 28C. More specifically, the ellipsoid reflector 66 is a half reflector partially surrounding the light source 28C above horizontal plane including the horizontal axis H. The first headlamp 12C further includes an aspherical lens 68 forward the light source 28C along the longitudinal axis L. The aspherical lens is centrally disposed on the longitudinal axis L. A filter 36C is disposed between the ellipsoid reflector 66 and the aspherical lens 68. In this embodiment, the filter 36C is disposed above the horizontal plane including the horizontal axis H. The first headlamp 12C can further include a block 64C disposed between the ellipsoid reflector 66 and the aspherical lens 68, below the filter 36C and below the horizontal plane including the horizontal axis H.

Without the filter 36C, the light source 28C forms the beam pattern 30$C_1$ illustrated in FIG. 5B and the light 22 emitted from the light source 28C includes light waves having an electric field vector oscillating in all directions that are perpendicular to the path of travel of the light waves. In other words, the light 22 emitted by the light source 28C has no particular overall polarization and includes S-polarized light. The foreground portion 32 of the beam pattern 30$C_1$ is the beam pattern generally under line F-F, and the non-foreground portion 34 of the beam pattern 30$C_1$ generally above the line F-F.

With the filter 36C, the light source 28C forms the beam pattern 30$C_2$ illustrated in FIG. 5C. The filter 36B has absorbed (and thus does not transmit) light waves of the light 22 emitted by the light source 28C that have an electric field vector oscillating in a direction parallel to the horizontal axis H. In other words, the filter 36C has absorbed the S-polarized light waves predominately from the foreground portion 32 of the beam pattern 30$C_1$ (represented under line F-F) and thus those light waves are not present in beam pattern 30$C_2$. Because filter 36C has absorbed a portion of the light 22 emitted by the light source 28C, the intensity of the light 22 at the foreground portion 32 below F-F (FIG. 5C) is less than if the filter 36C was not utilized (FIG. 5B). To overcome the decreased intensity of the light 22, the overall power of the light source 28C can be increased to compensate.

Figure 6:
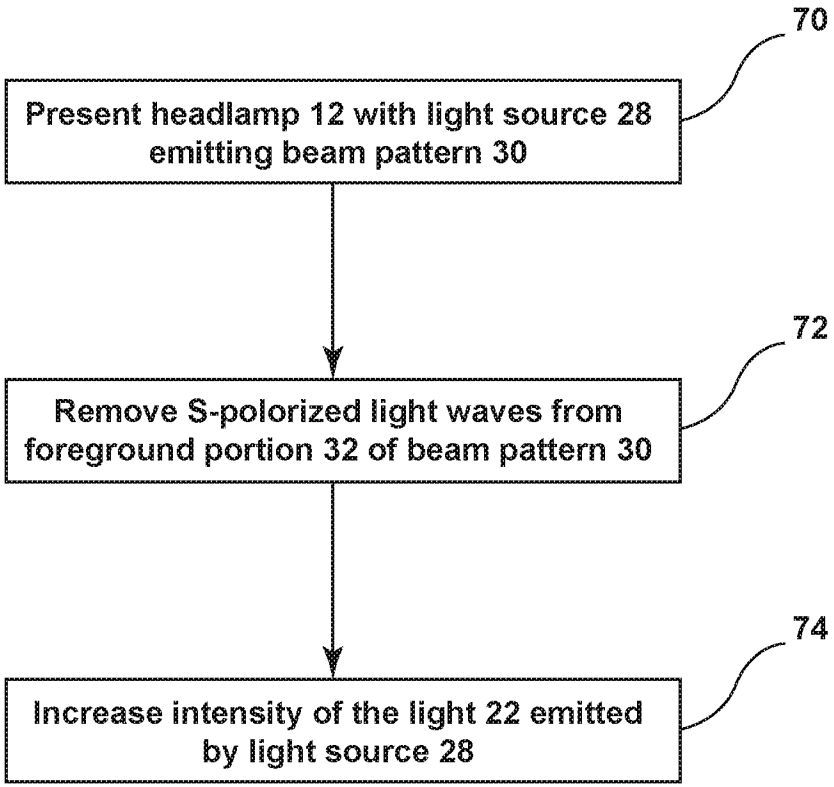
FIG. 6 is a flow chart for a method of reducing the amount of glare-inducing light that a vehicle headlamp produces during wet roadway conditions, utilizing the first headlamp of FIG. 1.

Referring now to FIG. 6, the first headlamp 12, including the embodiment first headlamps 12A-12C disclosed herein, can be utilized as part of a novel method of reducing the amount of glare-inducing light 22 that vehicle 10 headlamp 12 produces during wet roadway 26 conditions. The method, at step 70, includes presenting the first headlamp 12, which as discussed above includes the light source 28 that emits light 22 that forms a beam pattern 30. The emitted light 22, as explained above, includes light waves having an electric field vector oscillating in all directions perpendicular to a path of travel of the light wave. In other words, the emitted light 22 does not have a particular overall polarization. The beam pattern 30 has a foreground portion 32 relative to the horizontal axis H and a non-foreground portion 34, as illustrated in FIG. 1.

The method further comprises removing, at step 72, before the light 22 leaves the vehicle 10, from the foreground portion 32, light waves having an electric field vector oscillating in the horizontal direction relative to the roadway 26—that is, parallel to the roadway 26, assumed to be horizontal. In other words, the method includes removing, before the light 22 leaves the vehicle 10, from the foreground portion 32 of the beam pattern 30, light waves having an electric field vector oscillating parallel to the roadway 26. Because the roadway 26 is generally on a horizontal plane (not often tilted to a large degree to one side of the road or another), light waves having an electric field vector oscillating parallel to the roadway 26, if in the foreground portion 32 of the beam pattern 30, would bounce (reflect) more easily off of the roadway 26 and cause glare more than other light waves. In short, the method includes removing S-polarized light waves from the foreground portion 32 of the beam pattern 30 before the light 22 exits the vehicle 10 and has the opportunity to reflect off of the roadway 26.

Removing light waves having an electric field vector oscillating in a horizontal direction relative to the roadway 26 includes placing one or more filters 36 dedicated to the foreground portion 32 of the beam pattern 30 that do not transmit light waves having an electric field vector oscillating in a direction parallel to the horizontal axis H but do transmit light waves having an electric field vector oscillating in a direction perpendicular to the horizontal axis H. In other words, removing the S-polarized light waves can include placing one or more filters 36, such a S-polarized light absorbing polarizing sheet filters, in the path of light waves that would otherwise travel to the foreground portion 32, such that S-polarized light waves are absorbed (thus not transmitted) but non-S-polarized light waves are transmitted through the filter 36 and to the exterior 24 of the vehicle 10 to the roadway 26.

The method can further include, at step 74, increasing the intensity of the light 22 that the light source 28 emits. As explained above, because the one or more filters 36 remove light waves before the light waves exit the vehicle 10 and illuminate the roadway 26, the overall intensity of the beam pattern 30 is decreased, compared to if the one or more filters 36 were not present. Increasing the intensity of the light 22 emitted by the light source 28 when the one or more filters 36 are present can compensate for the decrease in intensity that the one or more filters 36 may cause.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A headlamp for a vehicle comprising:

a light source emitting light forming a beam pattern;

the light comprising light waves having an electric field vector oscillating in all directions perpendicular to a path of travel of the light wave; and the beam pattern comprising a foreground portion relative to a horizontal axis and a non-foreground portion; and one or more filters dedicated to the foreground portion of the beam pattern that does not transmit light waves having an electric field vector oscillating in a direction parallel to the horizontal axis but transmits other light waves having an electric field vector oscillating in directions other than parallel to the horizontal axis.

2. The headlamp of claim 1, wherein the light source is one or more light emitting diodes.

3. The headlamp of claim 1, wherein the one or more filters include an absorptive polarizer.

4. The headlamp of claim 3, wherein the absorptive polarizer is a polarizing sheet.

5. The headlamp of claim 1 further comprising:

a first reflector disposed above the light source;

a second reflector disposed below the light source; and a rectangular lens forward of the light source;

wherein, the light source includes more than one light emitting diode disposed horizontally parallel to the horizontal axis;

wherein, the one or more filters include a first filter and a second filter above the more than one light emitting diodes; and wherein, the one or more filters include a third filter and a fourth filter below the more than one light emitting diodes.

6. The headlamp of claim 1 further comprising:

a rectangular lens; and a torus lens disposed above the rectangular lens;

wherein, the light source includes more than one light emitting diodes disposed on a horizontal plane and rearward of the rectangular lens;

wherein, the light source further includes a light emitting diode rearward of the torus lens and above the rectangular lens; and wherein, at least one of the one or more filters is disposed adjacent the torus lens and between the torus lens and the light emitting diode rearward of the torus lens.

7. The headlamp of claim 1 further comprising:

an ellipsoid reflector above the light source; and an aspherical lens forward the light source and ellipsoid reflector;

wherein, the at least one of the one or more filters is disposed between the ellipsoid reflector and the aspherical lens.

8. A vehicle comprising:

a headlamp comprising:

a light source emitting light forming a beam pattern;

the light comprising light waves having an electric field vector oscillating in all directions perpendicular to a path of travel of the light wave; and the beam pattern comprising a foreground portion relative to a horizontal axis and a non-foreground portion; and one or more filters dedicated to the foreground portion of the beam pattern that does not transmit light waves having an electric field vector oscillating in a direction parallel to the horizontal axis but transmits other light waves having an electric field vector oscillating in directions other than parallel to the horizontal axis.

9. The vehicle of claim 8, wherein the light source is one or more light emitting diodes.

10. The vehicle of claim 8, wherein the one or more filters include an absorptive polarizer.

11. The vehicle of claim 10, wherein in the absorptive polarizer is a polarizing sheet.

12. The vehicle of claim 8, the headlamp further comprising:

a first reflector disposed above the light source;

a second reflector disposed below the light source; and a rectangular lens forward of the light source;

wherein, the light source includes more than one light emitting diode disposed horizontally parallel to the horizontal axis;

wherein, the one or more filters include a first filter and a second filter above the more than one light emitting diodes; and wherein, the one or more filters include a third filter and a fourth filter below the more than one light emitting diodes.

13. The vehicle of claim 8, the headlamp further comprising:

a rectangular lens; and a torus lens disposed above the rectangular lens;

wherein, the light source includes more than one light emitting diode disposed horizontally parallel to the horizontal axis and rearward of the rectangular lens;

wherein, the light source further includes a light emitting diode rearward of the torus lens and above the rectangular lens; and wherein, at least one of the one or more filters is disposed adjacent the torus lens and vertically between the torus lens and the light emitting diode rearward of the torus lens.

14. The vehicle of claim 8, the headlamp further comprising:

an ellipsoid reflector above the light source; and an aspherical lens forward the light source and ellipsoid reflector;

wherein, the at least one of the one or more filters is disposed between the ellipsoid reflector and the aspherical lens.

15. A method of reducing the amount of glare-inducing light that a vehicle headlamp produces during wet roadway conditions comprising:

presenting the headlamp comprising a light source emitting light forming a beam pattern;

the light comprising light waves having an electric field vector oscillating in all directions perpendicular to a path of travel of the light wave; and the beam pattern comprising a foreground portion relative to a horizontal axis and a non-foreground portion; and removing, with one or more filters, before the light leaves the vehicle, from the foreground portion, light waves having an electric field vector oscillating in a horizontal direction relative to the roadway but not other light waves having an electric field vector oscillating in directions other than parallel to the horizontal axis.

16. The method of claim 15, wherein removing light waves having an electric field vector oscillating in a horizontal direction relative to the roadway includes:

placing one or more filters dedicated to the foreground portion of the beam pattern that do not transmit light waves having an electric field vector oscillating in a direction parallel to the horizontal axis but do transmit light waves having an electric field vector oscillating in a direction perpendicular to the horizontal axis.

17. The method of claim 15, wherein the light source is one or more light emitting diodes.

18. The method of claim 15, wherein the one or more filters include an absorptive polarizer.

19. The method of claim 18, wherein the absorptive polarizer is a polarizing sheet.

20. The method of claim 15 further comprising:

increasing an intensity of the light that the light source emits.

* * * * *